United States Patent [19]

San Sebastian Saizar

[11] 4,106,470

[45] Aug. 15, 1978

[54] SAFETY APPARATUS FOR STOPPING AN INTERNAL COMBUSTION ENGINE IN RESPONSE TO IRREGULARITIES OCCUR IN THE OIL PRESSURE OR IN THE WATER TEMPERATURE

[76] Inventor: José Maria San Sebastian Saizar, c/Elcano, No. 15, Irun (Guipuzcoa), Spain

[21] Appl. No.: 689,832

[22] Filed: May 25, 1976

[30] Foreign Application Priority Data

May 28, 1975 [ES] Spain ..... 437.992

[51] Int. Cl.[2] ..... F02B 77/08

[52] U.S. Cl. ..... 123/198 DB; 123/41.15

[58] Field of Search .... 123/198 D, 198 DB, 198 DC, 123/41.15

[56] References Cited

U.S. PATENT DOCUMENTS

| | | | |
|---|---|---|---|
| Re. 27,108 | 3/1971 | Johnson et al. | 123/198 DB |
| 3,116,729 | 1/1964 | Crowe | 123/198 DC X |
| 3,362,388 | 1/1968 | Lindberg et al. | 123/198 D X |
| 3,533,391 | 10/1970 | Lockmuller | 123/198 DB |
| 3,602,207 | 8/1971 | Kilmer | 123/198 D X |
| 3,763,397 | 10/1973 | Yockers | 123/198 D X |

*Primary Examiner*—Charles J. Myhre
*Assistant Examiner*—Ira S. Lazarus
*Attorney, Agent, or Firm*—O'Brien and Marks

[57] ABSTRACT

A safety apparatus causes an internal combustion engine to be automatically stopped when irregularities are produced in the oil pressure or in the water temperature.

1 Claim, 2 Drawing Figures

FIG. 1
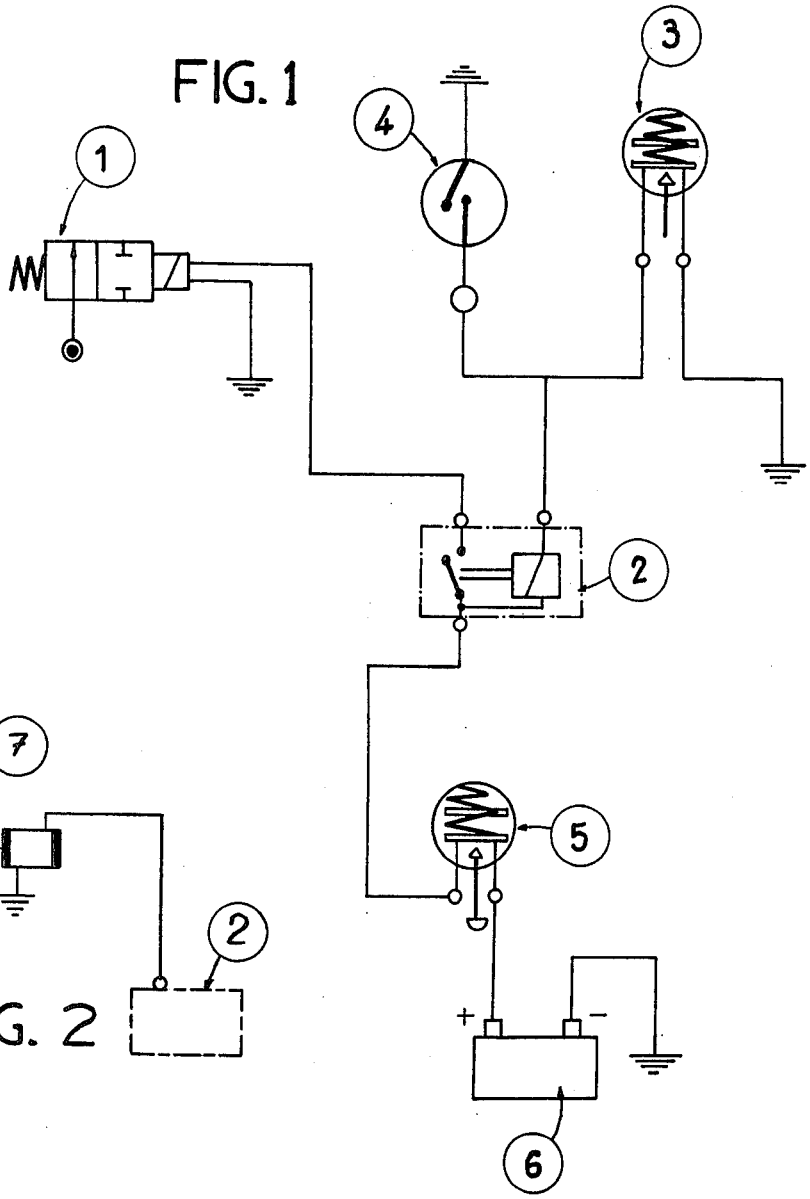
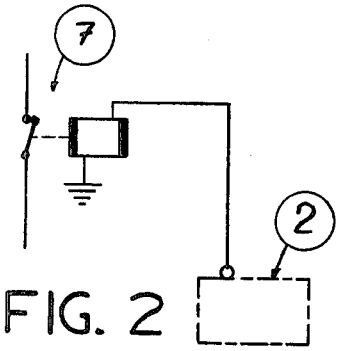
FIG. 2

SAFETY APPARATUS FOR STOPPING AN INTERNAL COMBUSTION ENGINE IN RESPONSE TO IRREGULARITIES OCCUR IN THE OIL PRESSURE OR IN THE WATER TEMPERATURE

BACKGROUND OF THE INVENTION

In vehicles employing water-cooled and pressurized-oil-lubricated internal combustion engines, inadequate oil pressure or excessively high temperature of the cooling water can cause very serious damage. The majority of engine-driven vehicles of this kind carry devices or warning lamps, indicative of the oil pressure and of the water temperature, on the instrument panel (dashboard) to warn the driver of the inadequate oil pressure or excessive high temperature. However, frequently, the attention of the driver is almost completely engaged by traffic, and an indication of inadequate oil pressure or excessively high temperature will not be noticed in time to avoid damage to the engine.

SUMMARY OF THE INVENTION

An object of the invention is to provide a warning means, operated by a serious drop in oil pressure or a serious rise in cooling water temperature, which can in no way be overlooked by the driver.

Another object of the invention is to construct a simple and easily installed safety apparatus for stopping an internal combustion engine as soon as there is a serious drop in the oil pressure or a serious rise in the cooling water temperature thereof.

In accordance with these and other objects the invention is summarized in an engine safety apparatus which comprises a relay controlling engine stopping means such as an electrially controlled valve through which the fuel passes or a switch which disables the ignition circuit of the engine, this relay being connected to an oil pressure actuated contact and to a water circuit temperature actuated contact, which contacts activate the relay when the oil pressure is too low or when the water temperature exceeds a specified value. The apparatus is further equipped with a manual switch which enables the safety apparatus to be deactivated when the engine is cutoff so that the vehicle can be restarted and driven to a repair garage or to some place where the vehicle will not interfere with other traffic. In this way a fault causing the irregularity in oil pressure or cooling water temperature can be discovered and rectified before really serious and expensive damage has been inflicted on the principal working parts of the engine.

BRIEF DESCRIPTION OF THE DRAWINGS

In order to further elucidate the subject matter of the invention, an embodiment is described below with reference to the appended drawing, wherein:

FIG. 1 is a diagram of an electrical circuit and apparatus in accordance with the invention.

FIG. 2 is a diagram of a modification of a portion of the apparatus of FIG. 1.

DESCRIPTION OF THE PREFERRED EMBODIMENTS

As illustrated in FIG. 1, a safety apparatus installed in a Diesel engine includes an electrically controlled valve 1, a relay 2, a low-oil-pressure actuated switch 3, a high-water-temperature actuated switch 4, and a manual disabling switch 5. The valve 1 is a normally open valve inserted in the fuel line between the filters and the injection pump of the engine so as to stop the flow of fuel when the winding of the valve is energized. Both switches 3 and 4 have output terminals connected to one end of the armature winding of the relay 2 which has a pair of normally open contacts connected in a series circuit including the winding of the valve 1, the manual switch 5, and an electrical source such as the battery 6 normally associated with such an engine.

For controlling energization of the winding of relay 2, the oil-pressure actuated switch 3 has normally closed contacts between the output terminal thereof and the ground circuit to the battery 6, and the water-temperature actuated switch 4 has normally open contacts between the output terminal thereof and the ground circuit; the normally closed contacts of the oil-pressure actuated switch 3 open only when the lubricating oil pressure for the engine is above a specified minimum value; and the normally open contacts of the water temperature actuated switch close when the cooling water for the engine reaches a specified excessively high temperature. Both the oil-pressure actuated switch 3 and the water-temperature actuated switch 4 can have additional outputs connected to monitoring devices or warning lights in the instrument control panel of the vehicle.

A connection is made from the other side of the winding of relay 2 to the junction between the relay 2 and the manual switch 5 which is normally closed to connect the hot terminal of the battery to the relay 2.

In operation of a vehicle with the safety apparatus for the engine, the loss of adequate oil pressure or an increase in cooling water temperature to an excessive value causes the flow of fuel to be terminated cutting off the engine; such cutting off of the engine very effectively warns the driver of the abnormal condition which must be corrected. More specifically, the dropping of the engine oil pressure below the minimum specified value allows the switch 3 to close and energize the relay 2 which then closes valve 1 terminating the flow of fuel. Or upon the cooling water for the engine reaching the specified excessively high temperature, the switch 4 closes to energize relay 2 and thus cause the termination of fuel flow.

To permit operation of the engine after cutoff by the safety apparatus, the driver actuates switch 5 to disable the safety apparatus by terminating electrical current flow from the battery 6 to deenergize the valve 1 and thus allow normal fuel flow. The vehicle can thus be driven a short distance so as to not impede traffic or to reach a facility where appropriate corrective action can be taken.

Where internal combustion engines with carburators are employed, the electrically controlled valve will have to be located in a position suitable for this type of engine, for example, upstream of the fuel pump, so as to prevent fuel passing from the fuel pump to the carburator.

Another modification, shown in FIG. 2, replaces the electrically controlled valve 1 by a relay or electrically operated switch 7 serially connected with the low voltage side of an ignition circuit of the engine, for example in series with the primary winding of a high voltage spark generating ignition coil. Operation of the safety apparatus in response to low oil pressure or high water temperature would stop ignition in the engine to warn the driver of the critical condition.

Since many modifications, variations and changes in detail can be made to the described embodiments, it is intended that all matter in the foregoing description and shown in the accompanying drawing be interpreted as illustrative and not in a limiting sense.

What is claimed is:

1. A safety apparatus for causing an internal combustion engine to stop automatically when irregularities occur in the oil pressure or in the water temperature, said apparatus comprising an oil-pressure-actuated switch having normally closed contacts which are held open when an oil pressure of the engine is above a minimum value, a water-temperature-actuated switch having normally open contacts which are closed when the temperature of a cooling liquid for the engine reaches a high temperature, an electrical relay having an armature winding and a pair of normally open contacts which are closed by energization of the armature winding, said oil-pressure-actuated switch and said water-temperature-actuated switch being connected in parallel to one side of the armature winding for controlling energization of the relay, a normally open electrically operated valve connected in series with a fuel line to the engine, said valve being electrically connected in series with the relay contacts, a manual switch which is normally closed connected in series with the relay contacts and the electrically operated valve for disabling the operation of the valve to allow the engine to be started, and said manual switch being free of any starter circuit so that the engine can be started and operated in the event of an irregularity when the manual switch is opened.

* * * * *